US005084692A

United States Patent [19]

Finch et al.

[11] Patent Number: 5,084,692

[45] Date of Patent: Jan. 28, 1992

[54] ROTARY ASSEMBLY COMBINED WITH AN ELECTRICAL SWITCH

[75] Inventors: Steven J. Finch, Sunrise; Armando J. Gonzalez, Miami; Jose M. Aleman, Coral Springs, all of Fla.

[73] Assignee: Motorola, Inc., Schaumburg, Ill.

[21] Appl. No.: 707,263

[22] Filed: May 24, 1991

Related U.S. Application Data

[63] Continuation of Ser. No. 431,804, Nov. 6, 1989, abandoned.

[51] Int. Cl.[5] ..... H01C 10/50

[52] U.S. Cl. ..... 338/198; 338/172; 338/176; 338/178; 338/179

[58] Field of Search ..... 338/198, 191, 172, 176, 338/178, 179; 200/5 R, 16 R

[56] References Cited

U.S. PATENT DOCUMENTS

| | | | |
|---|---|---|---|
| 3,209,297 | 4/1963 | Kmiecik et al. | 338/33 |
| 3,668,597 | 6/1972 | Nomura | 338/198 |
| 3,748,627 | 7/1973 | Zdanys, Jr. | 338/172 |
| 3,924,220 | 12/1975 | Matsui et al. | 338/172 |
| 3,952,278 | 4/1976 | Kiyono | 338/198 |
| 4,523,174 | 6/1985 | Oyama | 338/198 |
| 4,716,518 | 12/1987 | Hawkins et al. | 364/184 |
| 4,725,808 | 2/1988 | Mizuta | 338/176 |

*Primary Examiner*—Marvin M. Lateef
*Attorney, Agent, or Firm*—Robert S. Babayi

[57] ABSTRACT

A dual function rotary assembly (100) functions as a potentiometer and a momentary switch. The dual function assembly (100) includes a rotary shaft (106) that when rotated to a predetermined position, such as its final rotational position, may be pulled to provide a momentary contact between two switching terminals (116, 126).

7 Claims, 2 Drawing Sheets

ROTARY ASSEMBLY COMBINED WITH AN ELECTRICAL SWITCH

This is a continuation of application Ser. No. 431,804, filed Nov. 6, 1989 and now abandoned.

TECHNICAL FIELD

This invention relates generally to the field of dual function assemblies, in particular those assemblies which include a potentiometer function as well as a switching function.

BACKGROUND

Audio level adjustment of some electronic devices, such as portable two-way radios, may be achieved by rotating a knob which is coupled to a potentiometer of an audio control assembly. Generally, the knob is engaged to a rotating shaft, wherein rotating the knob increases or decreases the audio power delivered to a speaker. In some applications, it is desired to add a secondary function, such as a switching function, in order to provide additional operational features for the radio. For example, the radio may transmit an emergency signal when a user activates the switching function. However, the limitations imposed by the size of the radio may make addition of a separate or an integral switch on the radio housing difficult and even impossible. It is therefore, desirable to add the switching function to the embodiment of the audio control assembly.

Conventional dual function switches are used on a number of applications, such as car radios or home stereos, where the dual function may comprise switching from a first potentiometer function to a secondary potentiometer function or an on/off function. The secondary function is generally activated by pulling or pushing on the potentiometer shaft. In this arrangement, the secondary function is activated regardless of the rotational position of the rotary shaft.

However, in some applications, such as the above example, in order to minimizes the chances of inadvertent actuation emergency signal transmission by the user, it is desirable for the switching action to occur only when the rotary shaft of the assembly is in a predetermined position. Accordingly, it may be desired to activate the secondary function of the dual function assembly only when the rotary shaft is in a predetermined position.

SUMMARY OF THE INVENTION

Accordingly, it is an object of the present invention to provide a dual function assembly where the second function is activated only when a variable element of the assembly is in a predetermined position.

Briefly, according to the invention, the dual function assembly comprises a control element having a variable element for varying an electrical characteristic. The electrical characteristic is varied when the position of the variable element is varied. A switching means is coupled to the variable element and may be actuated only when the variable element is in at least one discrete predetermined position.

DETAILED DESCRIPTION OF THE PREFERRED EMBODIMENT

Figure 1:
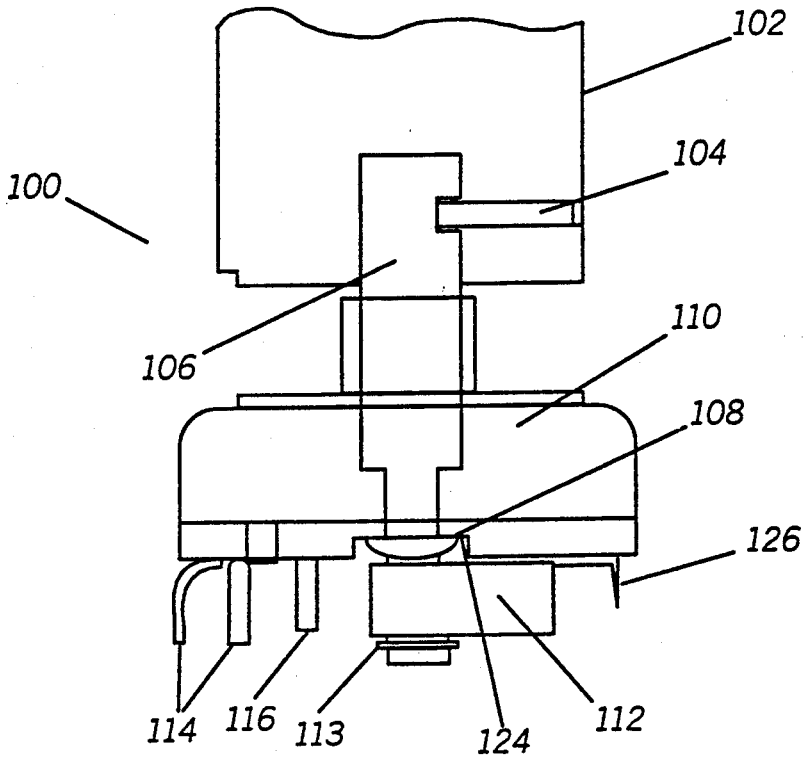
FIG. 1 is the cross sectional view of the potentiometer of the present invention.

Referring to FIG. 1, the preferred embodiment of a dual function assembly 100 is shown. The assembly 100 may function as a potentiometer, and it may function as a switch for providing a connection between switching terminals 126 and 116. One application for assembly 100 is in a microprocessor controlled portable two-way radio, wherein the potentiometer controls audio level and a microprocessor by sensing the connection of the switch terminals 116 and 126 may activate an optional feature, such as transmission of an emergency signal.

The assembly 100 includes a knob 102 which is attached to a rotary shaft 106 via a set screw 104. When the assembly 100 is functioning as a potentiometer, a variable resistance is provided at potentiometer terminals 114. It is conventional that the assembly 100 includes a control element 110 having a variable resistive characteristic. The rotary shaft 106 is coupled to the control element 110, and when rotated, the resistance across potentiometer terminals 114 is varied. Additionally, the assembly 100 includes a well known mechanism for stopping the rotation of the rotary shaft 110 when the rotary shaft 110 is rotated to a final rotational position. The rotary shaft 106 extends through the control element 110 and at one end carries a conductive guide 112. The conductive guide 112 is attached to the rotary shaft 106 by a clamping washer 113. A torsion spring 108 is positioned between the conductive guide 112 and a notch 124 located on the bottom surface of the control element 110. One of ordinary skill in the art will appreciate that this arrangement provides a mechanism, wherein a pull/release action returns the rotary shaft 110 to its original position.

Figure 2:
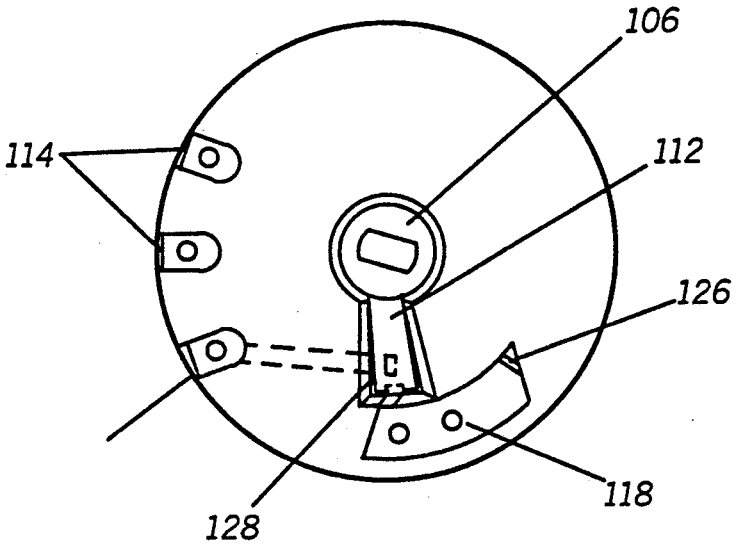
FIG. 2 is the bottom view of the potentiometer of FIG. 1.

Referring to FIG. 2, the cross sectional shape of the rotary shaft 106 and the corresponding aperture on the conductive guide 112 provide the locking mechanism, wherein the conductive guide 112 rotates as the rotary shaft 106 is rotated. Accordingly, by rotating the knob 102, the conductive guide 112 is rotated.

In the preferred embodiment of the invention, a momentary connection may be made between the switch terminals 116 and 126 when the the knob 102 is pulled only when the assembly 100 is at its fully rotated position. The assembly 100 is keyed to function as a switch only when the rotary shaft is in a discrete predetermined position. It will be appreciated that in this arrangement, the potentiometer function of the assembly 100 is a continuous and non-discrete function, while the switching function is a discrete function which may be activated only when the rotary shaft 106 is in a predetermined position.

Figure 3:
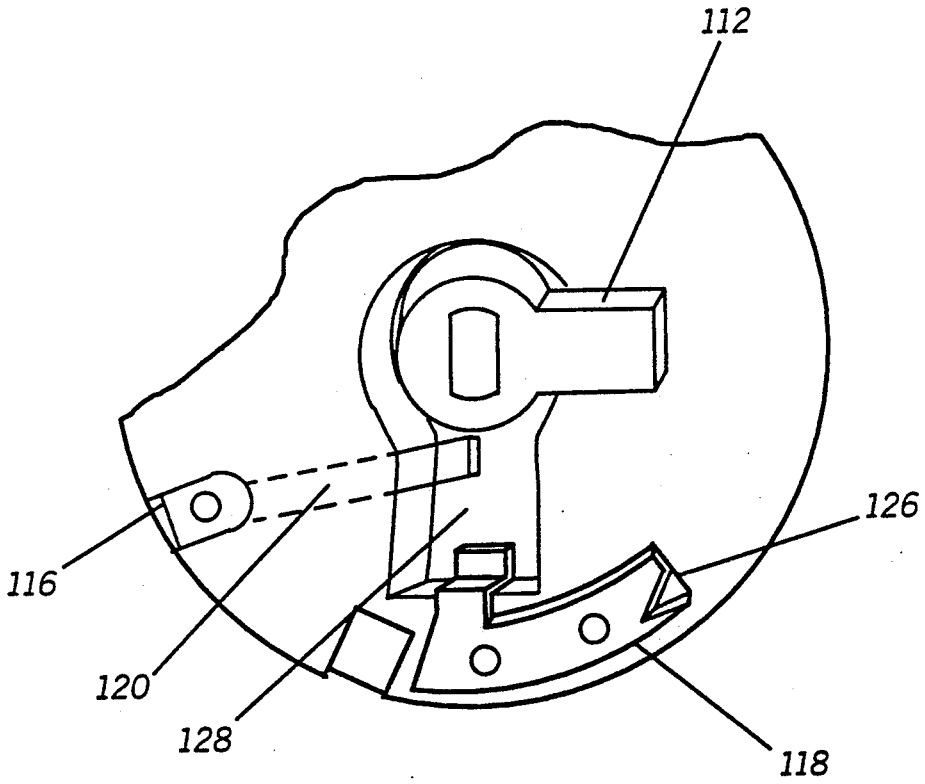
FIG. 3 is an enlarged fragmentary view of a portion of the view of FIG. 2.

Referring to FIG. 3, an enlarged view of the bottom portion of the assembly 100 is shown. A chamber 128 is formed on the bottom surface of the control element 110, and is aligned with the final rotational position of the conductive guide 112. The switch terminal 126 extends to form a switch contact 118, a portion of which is positioned inside the chamber 128. Therefore, when the conductive guide 112 is in the final rotational position, it is positioned directly above the switch contact 118. Similarly, the switch terminal 116 is extended in to the chamber 128 by a cantilever contact leg 120, such that it is positioned directly underneath the conductive guide 112, when the conductive guide 112 is in its final rotational position. In this arrangement, the conductive guide 102, when in the final rotational position and when moved longitudinally as by pulling upwardly, provides the connection between the switch contact 118 and the cantilever contact leg 120. The connection between the switch terminals 116 and 126 is maintained for as long as the knob 102 is pulled. When the knob 102 is released, the spring loaded mechanism of the assembly causes the conductive guide 112 to return to its original position, thereby breaking the connection between the switch terminals 116 and 126. Accordingly, the conductive guide 112, the cantilever contact leg 120, and the switch contact 118 constitute a switching means for the assembly 100.

One of ordinary skill in the art may appreciate that more than one switch terminals similar to switch terminals 116 and 126 may be connected at predetermined rotational positions of the knob 102. This may be achieved by providing similar arrangement as one formed by the chamber 128, the cantilever contact leg 120, and the switch contact 118 at predetermined discrete positions on the bottom surface of the control element 110. Accordingly, the arrangement formed by the chamber 128 constitutes a keying means which enable the switching means to be actuated only when the rotary shaft is in a predetermined discrete position.

Moreover, the switching action may be achieved by pushing the knob 102. In this arrangement, the conductive guide 112 may be arranged such that a continuous contact mechanism between the switch terminal 116 and 126 is provided, and when the knob is pushed the connection between the switch terminals 116 and 126 is broken. It may be appreciated that other variations of the present invention are possible. This disclosure is intended to encompass any and all of the possible variations which do not deviate from the true scope of the present invention.

What is claimed is:

1. An assembly, comprising:

a control element;

a variable element coupled to said control element wherein an electrical characteristic of said control element is varied by changing the position of said variable element by moving a shaft; and switching means coupled to said variable element and being actuated by moving said shaft longitudinally; said control element having at least one discrete switch actuation portion wherein said switching means may be actuated only when said variable element is positioned at said switch actuation portion.

2. The assembly of claim 1, wherein said switch actuation portion comprises a chamber situated on said control element.

3. The assembly of claim 1, wherein said control element comprise a rotary mechanism.

4. The assembly of claim 3, wherein said control element comprise a rotary potentiometer.

5. The assembly of claim 3, wherein said switching means includes two contacts which may be coupled to each other by a spring loaded conductive guide.

6. The assembly of claim 5, wherein said switching means is actuated by pulling said shaft.

7. The assembly of claim 5, wherein said switching means is actuated momentarily.

* * * * *